US009907411B2

(12) United States Patent
Burns et al.

(10) Patent No.: US 9,907,411 B2
(45) Date of Patent: Mar. 6, 2018

(54) CHILD SUPPORT UNIT FOR A PLAY YARD

(71) Applicant: KIDS II, INC., Atlanta, GA (US)

(72) Inventors: Stephen R. Burns, Cumming, GA (US); Chaitanya Tadipatri, Alpharetta, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 15/168,987

(22) Filed: May 31, 2016

(65) Prior Publication Data

US 2016/0270551 A1 Sep. 22, 2016

Related U.S. Application Data

(63) Continuation of application No. 14/088,985, filed on Nov. 25, 2013, now Pat. No. 9,351,588.

(60) Provisional application No. 61/831,862, filed on Jun. 6, 2013, provisional application No. 61/731,251, filed on Nov. 29, 2012.

(51) Int. Cl.

| | |
|---|---|
| ***A47D 7/00*** | (2006.01) |
| ***A47D 9/00*** | (2006.01) |
| ***A47D 7/04*** | (2006.01) |
| ***A47D 13/06*** | (2006.01) |
| ***A47D 5/00*** | (2006.01) |

(52) U.S. Cl.

CPC ..... *A47D 9/00* (2013.01); *A47D 5/00* (2013.01); *A47D 7/04* (2013.01); *A47D 13/06* (2013.01); *A47D 13/061* (2013.01); *A47D 13/063* (2013.01)

(58) Field of Classification Search

CPC ..... A47D 7/00
USPC ..... 5/93.1, 98.1, 93.2, 99.1, 102
See application file for complete search history.

(56) References Cited

U.S. PATENT DOCUMENTS

| | | | |
|---|---|---|---|
| 548,901 | A | 10/1895 | Welch |
| 633,353 | A | 9/1899 | Bacon |
| 914,309 | A | 3/1909 | Ross |
| 929,792 | A | 8/1909 | Seifert |
| 1,183,819 | A | 5/1916 | Keiser |
| 1,288,347 | A | 12/1918 | Wilson |
| 1,374,333 | A | 4/1921 | Stotler et al. |
| 1,391,650 | A | 9/1921 | Truesdell et al. |
| 1,427,598 | A | 8/1922 | Jackson |
| 1,493,505 | A | 5/1924 | Smith |
| 1,499,821 | A | 7/1924 | Griffiths |
| 1,512,522 | A | 10/1924 | Colburn |
| 1,545,446 | A | 7/1925 | Paulet |
| 1,620,933 | A | 3/1927 | Wilcox |

(Continued)

FOREIGN PATENT DOCUMENTS

| | | | |
|---|---|---|---|
| AU | 1652788 | A | 12/1988 |
| AU | 715883 | B3 | 2/2000 |

(Continued)

*Primary Examiner* — Frederick C Conley
(74) *Attorney, Agent, or Firm* — Gardner Groff Greenwald & Villanueva, PC

(57) ABSTRACT

A play yard system for infants or small children. They play yard includes a frame, and the system includes at least one child support unit for mounting to the frame of the play yard. The at least one child support unit may take the form of a bassinet and/or a changing table. The play yard frame may be collapsible for storage and transport, and the child support unit may be removable from the play yard frame.

26 Claims, 6 Drawing Sheets

(56) References Cited

U.S. PATENT DOCUMENTS

| | | | |
|---|---|---|---|
| 1,658,944 | A | 2/1928 | Schaeffer |
| 1,669,484 | A | 5/1928 | Mowry |
| 1,724,479 | A | 8/1929 | Havener |
| 1,757,241 | A | 5/1930 | Forse |
| 1,794,561 | A | 3/1931 | Taylor |
| 1,812,971 | A | 7/1931 | McCandless |
| 1,827,687 | A | 10/1931 | McCandless |
| 1,839,580 | A | 1/1932 | Myron |
| 1,900,274 | A | 3/1933 | Brockie |
| 1,975,332 | A | 10/1934 | Rehkopf |
| 2,041,509 | A | 5/1936 | O'Byrne |
| 2,194,320 | A | 3/1940 | Pearson |
| 2,245,961 | A | 6/1941 | Clay |
| 2,280,913 | A | 4/1942 | Hummel et al. |
| 2,287,907 | A | 6/1942 | Schettler, Jr. |
| 2,345,295 | A | 3/1944 | Schettler, Jr. |
| 2,381,759 | A | 8/1945 | Lanese |
| 2,386,721 | A | 10/1945 | Sedita |
| 2,420,898 | A | 5/1947 | Miner |
| 2,491,036 | A | 12/1949 | Dodge |
| 2,493,083 | A | 1/1950 | Pascoo |
| 2,498,203 | A | 2/1950 | Fischer |
| D158,038 | S | 4/1950 | Barmache et al. |
| 2,508,506 | A | 5/1950 | Fridolph |
| 2,536,731 | A | 1/1951 | Douglas |
| 2,548,769 | A | 4/1951 | Burgin |
| 2,553,087 | A | 5/1951 | Hanson |
| 2,553,579 | A | 5/1951 | Harris |
| 2,563,915 | A | 8/1951 | Boisselier |
| 2,566,594 | A | 9/1951 | Brown |
| 2,574,079 | A | 11/1951 | White |
| 2,574,559 | A | 11/1951 | Graf et al. |
| 2,590,315 | A | 3/1952 | Hawley, Jr. |
| 2,595,532 | A | 5/1952 | Leitner |
| 2,604,333 | A | 7/1952 | Elmer |
| 2,607,052 | A | 8/1952 | Le Roy |
| 2,610,332 | A | 9/1952 | Field |
| 2,614,264 | A | 10/1952 | Schmidt, Jr. |
| 2,632,186 | A | 3/1953 | Berk et al. |
| 2,645,540 | A | 7/1953 | Trimble et al. |
| 2,645,786 | A | 7/1953 | Loftin |
| 2,654,098 | A | 10/1953 | Heyward |
| 2,681,659 | A | 6/1954 | Hrinsin |
| 2,686,922 | A | 8/1954 | La Vigne |
| 2,688,997 | A | 9/1954 | Miller |
| 2,698,443 | A | 1/1955 | Ralick |
| 2,709,478 | A | 5/1955 | Golding et al. |
| 2,710,976 | A | 6/1955 | Martensen |
| 2,752,614 | A | 7/1956 | Hayward |
| 2,761,152 | A | 9/1956 | Pirone et al. |
| 2,790,978 | A | 5/1957 | Tigrett |
| 2,828,489 | A | 4/1958 | Baker |
| 2,828,756 | A | 4/1958 | Worley |
| 2,831,199 | A | 4/1958 | Stanley |
| 2,851,700 | A | 9/1958 | Denison |
| 2,895,717 | A | 7/1959 | De Falco |
| 2,922,169 | A | 1/1960 | Werner |
| 2,963,712 | A | 12/1960 | Cole |
| 2,980,058 | A | 4/1961 | Hoffman |
| 2,986,150 | A | 5/1961 | Torian |
| 2,992,441 | A | 7/1961 | Landry |
| 3,012,254 | A | 12/1961 | Hamilton |
| 3,018,493 | A | 1/1962 | Wittbrodt |
| 3,044,078 | A | 7/1962 | Hamilton |
| 3,064,277 | A | 11/1962 | Gill |
| 3,078,478 | A | 2/1963 | Sheahan |
| 3,092,847 | A | 6/1963 | De Puy |
| 3,103,670 | A | 9/1963 | Landry |
| 3,135,970 | A | 6/1964 | Trent et al. |
| 3,156,197 | A | 11/1964 | Walz |
| 3,162,460 | A | 12/1964 | Davidson |
| 3,165,760 | A | 1/1965 | Abajian |
| 3,183,528 | A | 5/1965 | Jacobs et al. |
| 3,206,772 | A | 9/1965 | Sarasin |
| 3,206,773 | A | 9/1965 | Sarasin |
| 3,222,841 | A | 12/1965 | Lipof |
| 3,225,364 | A | 12/1965 | Miret |
| 3,296,633 | A | 1/1967 | Rieger |
| 3,311,934 | A | 4/1967 | Goldberg |
| 3,330,575 | A | 7/1967 | Boudreau |
| 3,339,213 | A | 9/1967 | Spencer |
| 3,341,096 | A | 9/1967 | Stanley |
| 3,358,725 | A | 12/1967 | Bussard et al. |
| 3,424,178 | A | 1/1969 | Yazaki |
| 3,427,666 | A | 2/1969 | Saxe |
| 3,466,677 | A | 9/1969 | Glaser et al. |
| 3,574,872 | A | 4/1971 | Mattila |
| 3,631,547 | A | 1/1972 | Massie |
| 3,640,576 | A | 2/1972 | Morrison et al. |
| 3,643,942 | A | 2/1972 | Williams |
| 3,644,947 | A | 2/1972 | Padera |
| 3,656,194 | A | 4/1972 | Perego |
| 3,670,747 | A | 6/1972 | Pohl et al. |
| 3,735,430 | A | 5/1973 | Platz |
| 3,789,439 | A | 2/1974 | Berg et al. |
| 3,848,277 | A | 11/1974 | Reguitti |
| 3,848,278 | A | 11/1974 | Propst |
| 3,875,623 | A | 4/1975 | Johnston |
| 3,886,607 | A | 6/1975 | Dunn |
| 3,912,407 | A | 10/1975 | Heininger |
| 3,977,721 | A | 8/1976 | Peterson |
| 3,978,532 | A | 9/1976 | Scheiner |
| 3,996,650 | A | 12/1976 | Tonn |
| 4,043,349 | A | 8/1977 | Gays et al. |
| 4,070,716 | A | 1/1978 | Satt et al. |
| 4,103,401 | A | 8/1978 | Conley |
| 4,105,244 | A | 8/1978 | Colby |
| 4,107,826 | A | 8/1978 | Tysdal |
| 4,123,809 | A | 11/1978 | Pugh |
| 4,124,906 | A | 11/1978 | Millard et al. |
| 4,186,454 | A | 2/1980 | Cone |
| 4,190,916 | A | 3/1980 | McMullan |
| 4,216,951 | A | 8/1980 | Griffin |
| D257,299 | S | 10/1980 | Cone |
| D260,827 | S | 9/1981 | Sommer |
| 4,302,048 | A | 11/1981 | Yount |
| 4,361,919 | A | 12/1982 | Hull |
| 4,375,110 | A | 3/1983 | Murphy |
| 4,376,318 | A | 3/1983 | Cirillo |
| 4,466,146 | A | 8/1984 | Regan |
| 4,491,992 | A | 1/1985 | Wittman |
| 4,525,883 | A | 7/1985 | Necowitz |
| 4,538,309 | A | 9/1985 | Gunter |
| 4,558,904 | A | 12/1985 | Schultz |
| 4,631,786 | A | 12/1986 | Curry |
| 4,651,367 | A | 3/1987 | Osher et al. |
| 4,669,138 | A | 6/1987 | Kassai |
| 4,688,280 | A | 8/1987 | Kohus et al. |
| 4,694,543 | A | 9/1987 | Conley |
| 4,703,525 | A | 11/1987 | Shamie |
| 4,715,075 | A | 12/1987 | Shamie |
| 4,726,411 | A | 2/1988 | Conley |
| 4,739,527 | A | 4/1988 | Kohus et al. |
| 4,750,223 | A | 6/1988 | D'Arcy et al. |
| 4,790,340 | A | 12/1988 | Mahoney |
| 4,799,299 | A | 1/1989 | Campbell |
| 4,811,437 | A | 3/1989 | Dillner et al. |
| 4,819,284 | A | 4/1989 | Brown |
| 4,819,285 | A | 4/1989 | Fetters |
| 4,837,875 | A | 6/1989 | Shamie et al. |
| 4,847,958 | A | 7/1989 | Conley |
| 4,878,322 | A | 11/1989 | Ikeda et al. |
| 4,890,346 | A | 1/1990 | Rist |
| 4,891,852 | A | 1/1990 | Lopez, Jr. |
| 4,898,111 | A | 2/1990 | Hackney |
| 4,899,496 | A | 2/1990 | Chew, II |
| 4,900,011 | A | 2/1990 | Nolet |
| 4,925,245 | A | 5/1990 | Pendleton et al. |
| 4,945,584 | A | 8/1990 | LaMantia |
| 4,965,896 | A | 10/1990 | Berger et al. |
| 4,967,432 | A | 11/1990 | Kujawski et al. |
| 4,985,948 | A | 1/1991 | Mariol |
| 4,999,863 | A | 3/1991 | Kane |
| 5,077,846 | A | 1/1992 | Wheeler, III et al. |

(56) References Cited

U.S. PATENT DOCUMENTS 5,081,723 A 1/1992 Saunders
5,092,001 A 3/1992 Ross et al.
5,099,866 A 3/1992 Solis et al.
5,140,718 A 8/1992 Toth
5,163,191 A 11/1992 Chan
5,172,435 A 12/1992 Griffin et al.
5,187,826 A 2/1993 Mariol
5,226,440 A 7/1993 Fuhrman
5,274,863 A 1/1994 Fountain
5,279,006 A 1/1994 Teng
5,293,655 A 3/1994 VanWinkle et al.
5,293,656 A 3/1994 Chan
5,297,305 A 3/1994 Williams
5,299,336 A 4/1994 Marteeny
5,335,685 A 8/1994 Dahulich
5,339,470 A 8/1994 Shamie
5,349,709 A 9/1994 Cheng
D352,843 S 11/1994 Szebegyinszki
5,360,258 A 11/1994 Alivizatos
5,377,368 A 1/1995 Cheng
5,381,570 A 1/1995 Cheng
5,390,463 A 2/1995 Sollner
D358,717 S 5/1995 Foreman
5,414,873 A 5/1995 Wolf
5,430,899 A 7/1995 Chisholm
5,446,934 A 9/1995 Frazier
5,450,703 A 9/1995 Fuhrman et al.
5,465,439 A 11/1995 Chien
5,473,785 A 12/1995 Lager et al.
D366,978 S 2/1996 Mariol
5,504,951 A 4/1996 Yeh
5,517,707 A 5/1996 LaMantia
5,526,542 A 6/1996 Huang
5,542,134 A 8/1996 Wang
5,545,151 A 8/1996 O'Connor et al.
5,553,336 A 9/1996 Mariol
5,555,577 A 9/1996 Volpe
5,581,827 A 12/1996 Fong et al.
5,615,427 A 4/1997 Huang
5,617,592 A 4/1997 Cheng
5,697,111 A 12/1997 Dillner et al.
5,711,040 A 1/1998 Huang
5,716,101 A 2/1998 Frinier et al.
5,722,477 A 3/1998 Richter et al.
5,727,265 A 3/1998 Ziegler et al.
5,752,297 A 5/1998 Ramey
5,758,868 A 6/1998 Shea
5,761,754 A 6/1998 Cheng
5,762,403 A 6/1998 Robinson
5,778,465 A 7/1998 Myers
5,791,363 A 8/1998 Moses
5,791,804 A 8/1998 Cheng
5,802,634 A 9/1998 Onishi et al.
5,813,064 A 9/1998 Hartenstine
5,819,341 A 10/1998 Simantob et al.
5,819,342 A 10/1998 Williams
5,826,285 A 10/1998 Mariol et al.
5,845,349 A 12/1998 Tharalson et al.
5,845,379 A 12/1998 Steffensen
5,845,666 A 12/1998 Messner
5,862,548 A 1/1999 Gerhart
5,867,850 A 2/1999 Mariol
5,867,851 A 2/1999 Mariol et al.
5,878,802 A 3/1999 Richter et al.
5,884,348 A 3/1999 Onishi et al.
5,913,771 A 6/1999 Nail
5,918,329 A 7/1999 Huang
D413,025 S 8/1999 Mariol et al.
D413,151 S 8/1999 Breuil
5,947,552 A 9/1999 Wilkins et al.
5,956,786 A 9/1999 Huang
5,963,996 A 10/1999 Hsia
5,991,944 A 11/1999 Yang
5,992,348 A 11/1999 Harding
6,058,528 A 5/2000 Yang
6,065,163 A 5/2000 Hung
6,067,676 A 5/2000 Carnahan et al.
6,082,385 A 7/2000 Burford et al.
6,098,217 A 8/2000 Hammil
6,123,091 A 9/2000 Flynn et al.
6,123,321 A 9/2000 Miller
6,125,483 A 10/2000 Stroud et al.
6,131,218 A 10/2000 Wang
6,148,488 A 11/2000 Gristock
6,182,308 B1 2/2001 Yang
6,192,535 B1 2/2001 Warner, Jr. et al.
6,221,036 B1 4/2001 Lucas
6,233,759 B1 5/2001 Warner, Jr. et al.
6,250,837 B1 6/2001 Mariol et al.
6,256,814 B1 7/2001 Drobinski
6,293,624 B1 9/2001 Gaylord et al.
6,317,907 B1 11/2001 Wang
6,339,856 B1 1/2002 Chen et al.
6,345,638 B1 2/2002 Warner
6,349,434 B1 2/2002 Zhuang
6,406,093 B1 6/2002 Miotto et al.
6,418,575 B1 7/2002 Cheng
6,438,773 B1 8/2002 Hsia
6,467,108 B1 10/2002 Wang
6,470,515 B1 10/2002 Hsia
6,510,568 B1 1/2003 Drobinski et al.
6,510,570 B2 1/2003 Hartenstine et al.
6,526,608 B1 3/2003 Hsia
6,532,701 B2 3/2003 Williams
6,539,563 B1 4/2003 Hsia
6,543,070 B2 4/2003 Longenecker et al.
6,550,082 B2 4/2003 Tharalson et al.
6,560,827 B1 5/2003 Gross
6,578,211 B2 6/2003 Tharalson et al.
6,588,033 B1 7/2003 Welsh, Jr. et al.
6,665,895 B1 12/2003 St. Pierre et al.
6,701,586 B2 3/2004 Conley et al.
6,721,971 B1 4/2004 Cheng
6,735,796 B2 * 5/2004 Warner, Jr. ..... A47D 5/006 5/93.1
6,758,014 B2 7/2004 Chen
6,859,957 B1 3/2005 Chen
6,859,958 B2 3/2005 LaMantia
6,874,177 B2 4/2005 Hsia
6,877,173 B2 4/2005 Tharalson et al.
6,901,613 B1 6/2005 Hsia
6,948,197 B1 9/2005 Chen
6,952,849 B2 10/2005 Pacella
6,954,949 B1 10/2005 Chen
7,003,823 B1 2/2006 Reed et al.
7,013,505 B2 3/2006 Martin
7,043,779 B2 5/2006 Mendenhall et al.
7,055,192 B2 6/2006 Waters et al.
7,090,201 B2 8/2006 Brucker
7,100,625 B2 9/2006 Valles
7,111,339 B2 9/2006 Chen
7,228,575 B2 6/2007 Chen
7,263,729 B2 9/2007 Paesang et al.
7,346,943 B2 3/2008 Chen
7,376,993 B2 5/2008 Myers et al.
7,401,366 B1 7/2008 Costa
7,415,739 B2 8/2008 Tharalson et al.
7,418,745 B2 9/2008 Paesang et al.
7,448,098 B2 11/2008 Cheng
7,458,114 B2 12/2008 Troutman
7,509,694 B2 3/2009 Chen
7,526,821 B2 5/2009 Chen et al.
7,568,242 B2 8/2009 Troutman
7,568,243 B2 8/2009 Gehr et al.
7,581,269 B2 9/2009 Chen et al.
7,591,031 B2 9/2009 Yang
7,739,759 B2 6/2010 Mendes et al.
7,770,245 B2 8/2010 Cheng et al.
7,818,832 B2 10/2010 Hartenstine et al.
7,836,530 B2 11/2010 Thorne et al.
7,882,579 B2 2/2011 Jackson et al.
7,908,686 B2 3/2011 Clapper et al.
7,937,786 B2 5/2011 Bergkvist
7,937,790 B2 5/2011 Zhao et al.

(56) References Cited

U.S. PATENT DOCUMENTS

| | | | |
|---|---|---|---|
| 7,938,135 | B2 | 5/2011 | Desfosses et al. |
| 7,950,081 | B2 | 5/2011 | Chen et al. |
| 7,958,578 | B2 | 6/2011 | Shan et al. |
| 8,001,630 | B2 | 8/2011 | Burkholder et al. |
| 8,011,036 | B2 | 9/2011 | Tuckey |
| 8,028,234 | B2 | 9/2011 | Li |
| 8,028,358 | B2 | 10/2011 | Fiore, Jr. |
| 8,141,186 | B2 | 3/2012 | Burns et al. |
| 8,201,291 | B2 | 6/2012 | Burns et al. |
| 8,230,536 | B2 | 7/2012 | Clapper et al. |
| 8,257,229 | B2 | 9/2012 | Myers et al. |
| 8,281,431 | B2 | 10/2012 | Hartenstine |
| 8,291,530 | B2 | 10/2012 | Burkholder et al. |
| 8,307,475 | B2 | 11/2012 | Hutchinson et al. |
| 8,316,481 | B2 | 11/2012 | Arnold, IV et al. |
| 8,316,483 | B2 | 11/2012 | Thomas et al. |
| 8,321,973 | B2 | 12/2012 | Bickley |
| RE43,919 | E | 1/2013 | Chen |
| 8,387,807 | B2 | 3/2013 | Chen et al. |
| 8,403,421 | B2 | 3/2013 | Wang |
| 8,424,131 | B2 | 4/2013 | Thomsen et al. |
| 8,491,215 | B2 | 7/2013 | Young |
| 8,522,374 | B2 | 9/2013 | Sousa et al. |
| 8,528,130 | B2 | 9/2013 | Bu et al. |
| 8,544,125 | B2 | 10/2013 | Greger et al. |
| 8,555,434 | B2 | 10/2013 | Chapman et al. |
| 8,566,988 | B2 | 10/2013 | Son et al. |
| 8,607,379 | B2 | 12/2013 | Yoshie et al. |
| 8,677,533 | B2 | 3/2014 | Barron et al. |
| 8,764,612 | B2 | 7/2014 | Myers et al. |
| 8,806,673 | B2 | 8/2014 | Burkholder et al. |
| 8,893,325 | B2 | 11/2014 | Arnold, IV et al. |
| 8,925,128 | B2 | 1/2015 | Fiore, Jr. et al. |
| 8,997,277 | B2 | 4/2015 | Thomas et al. |
| 9,066,607 | B1 | 6/2015 | Ransil et al. |
| 9,078,530 | B2 | 7/2015 | Ingram et al. |
| 9,089,225 | B2 | 7/2015 | Fiore, III et al. |
| 9,101,226 | B1 | 8/2015 | Hartenstine et al. |
| 9,113,723 | B2 | 8/2015 | Greger et al. |
| 9,179,786 | B1 | 11/2015 | Ransil et al. |
| 9,198,524 | B2 | 12/2015 | Horst et al. |
| 9,332,860 | B2 | 5/2016 | Rong et al. |
| 9,351,587 | B2 | 5/2016 | Burns et al. |
| 9,351,588 | B2 | 5/2016 | Burns et al. |
| 9,364,098 | B2 | 6/2016 | Fiore, III et al. |
| 9,565,950 | B2 | 2/2017 | Horst et al. |
| 2001/0001330 | A1 | 5/2001 | Warner, Jr. et al. |
| 2003/0154547 | A1 | 8/2003 | Hsia |
| 2003/0177575 | A1 | 9/2003 | Cheng et al. |
| 2005/0150053 | A1 | 7/2005 | Hartenstine |
| 2005/0210580 | A1 | 9/2005 | Clapper |
| 2006/0000019 | A1 | 1/2006 | Martin |
| 2006/0021138 | A1 | 2/2006 | Waldman et al. |
| 2006/0080776 | A1 | 4/2006 | Clapper et al. |
| 2006/0218725 | A1 | 10/2006 | Carpenter et al. |
| 2006/0225204 | A1 | 10/2006 | Bretschger et al. |
| 2006/0230528 | A1 | 10/2006 | Church |
| 2007/0017025 | A1 | 1/2007 | Myer |
| 2007/0204403 | A1 | 9/2007 | Hartenstine |
| 2007/0204404 | A1 | 9/2007 | Hartenstine |
| 2007/0271697 | A1 | 11/2007 | Martin |
| 2009/0172879 | A1 | 7/2009 | Hsu |
| 2010/0132115 | A1 | 6/2010 | Hsu |
| 2010/0138991 | A1 | 6/2010 | Hartenstine et al. |
| 2013/0086750 | A1 | 4/2013 | Cheng |
| 2013/0125304 | A1 | 5/2013 | DeHart et al. |
| 2013/0133136 | A1 | 5/2013 | Cheng |
| 2014/0068857 | A1 | 3/2014 | Jackson et al. |
| 2014/0215713 | A1 | 8/2014 | Myers et al. |

FOREIGN PATENT DOCUMENTS

| | | | |
|---|---|---|---|
| CN | 2062705 | U | 9/1990 |
| CN | 2103947 | U | 5/1992 |
| CN | 2124842 | U | 12/1992 |
| CN | 2183707 | Y | 11/1994 |
| CN | 2409851 | Y | 12/2000 |
| CN | 2409852 | Y | 12/2000 |
| CN | 2680127 | Y | 2/2005 |
| CN | 2732096 | Y | 10/2005 |
| CN | 101305878 | A | 11/2008 |
| CN | 101352294 | A | 1/2009 |
| CN | 102824062 | A | 12/2012 |
| DE | 1648212 | U | 12/1952 |
| DE | 2856168 | A1 | 7/1980 |
| DE | 8705939 | U1 | 9/1987 |
| DE | 4131444 | A1 | 4/1993 |
| DE | 4327819 | A1 | 2/1994 |
| DE | 20000537 | U1 | 8/2000 |
| DE | 602004001386 | T2 | 6/2007 |
| DE | 202008018316 | U1 | 1/2013 |
| EP | 0288047 | A1 | 10/1988 |
| EP | 0419034 | A1 | 3/1991 |
| EP | 0534215 | A1 | 3/1993 |
| EP | 0920825 | A1 | 6/1999 |
| EP | 0993795 | A1 | 4/2000 |
| EP | 1082927 | A1 | 3/2001 |
| EP | 1147727 | A1 | 10/2001 |
| EP | 1550387 | B1 | 6/2006 |
| EP | 2022374 | A1 | 2/2009 |
| EP | 2165629 | A1 | 3/2010 |
| EP | 2359719 | A1 | 8/2011 |
| EP | 2710930 | A2 | 3/2014 |
| EP | 2868235 | A1 | 5/2015 |
| FR | 2593369 | A1 | 7/1987 |
| GB | 145855 | A | 6/1920 |
| GB | 1011512 | | 12/1965 |
| GB | 2330070 | A | 4/1999 |
| GB | 2413280 | A | 10/2005 |
| JP | S5613224 | A | 2/1981 |
| JP | S6295629 | U | 6/1987 |
| JP | 1989124412 | | 5/1989 |
| JP | H03115561 | U | 11/1991 |
| JP | H0975140 | A | 3/1997 |
| JP | H119402 | A | 1/1999 |
| NL | 8400112 | A | 8/1985 |
| WO | 9305686 | A1 | 4/1993 |
| WO | 9836666 | A1 | 8/1998 |
| WO | 2013003320 | A2 | 1/2013 |

* cited by examiner

CHILD SUPPORT UNIT FOR A PLAY YARD

CROSS-REFERENCE TO RELATED APPLICATIONS

This application claims the benefit of U.S. Provisional Patent Application Ser. No. 61/731,251 filed Nov. 29, 2012, U.S. Provisional Patent Application Ser. No. 61/827,051 filed May 24, 2013 and U.S. Provisional Patent Application Ser. No. 61/831,362 filed Jun. 6, 2013, the entireties of which are hereby incorporated by reference herein.

TECHNICAL FIELD

The present invention relates generally to the field of child care accessories, and more particularly to a child support unit for a play yard and a play yard including such a child support unit.

BACKGROUND

Play yard devices are utilized to provide a safe and comfortable enclosure in which infants and small children can play and rest. It is to the provision of improvements to such devices that the present invention is primarily directed.

SUMMARY

In one example aspect, the present invention relates to a child support unit for a play yard. The play yard includes a frame, and the child support unit includes a subframe and at least one coupling for attachment the child support unit to the frame of the play yard.

In another aspect, the invention relates to a system including a play yard and a child support unit. At least one coupling is provided between the child support unit and the play yard for mounting the child support unit to the play yard.

In still another aspect, the invention relates to a method of attachment child support unit to a play yard device, the method including coupling a subframe of the child support unit to the frame of the play yard.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
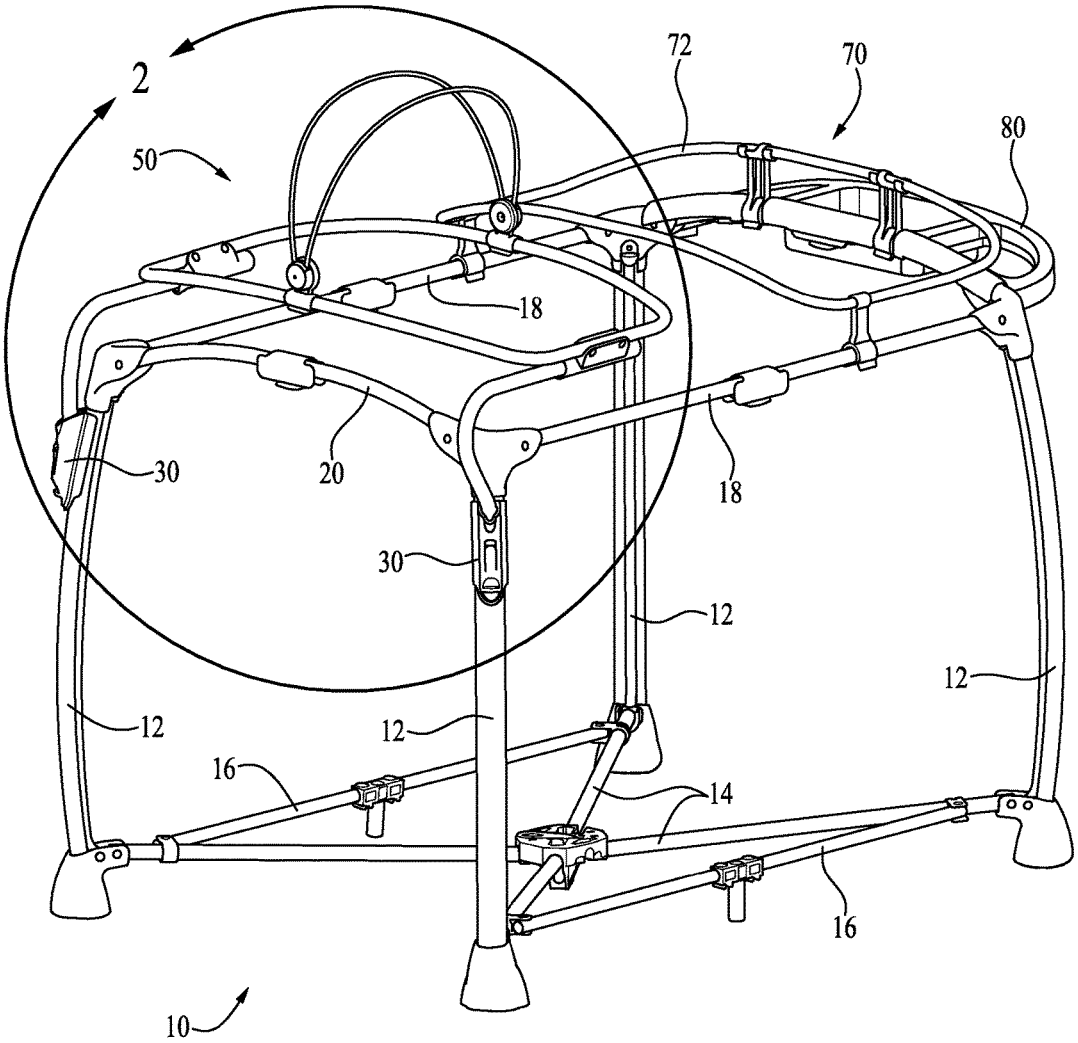
FIG. 1 is a perspective view of a play yard system having first and second child support units mounted thereto, according to an example embodiment of the present invention.
Figure 4:
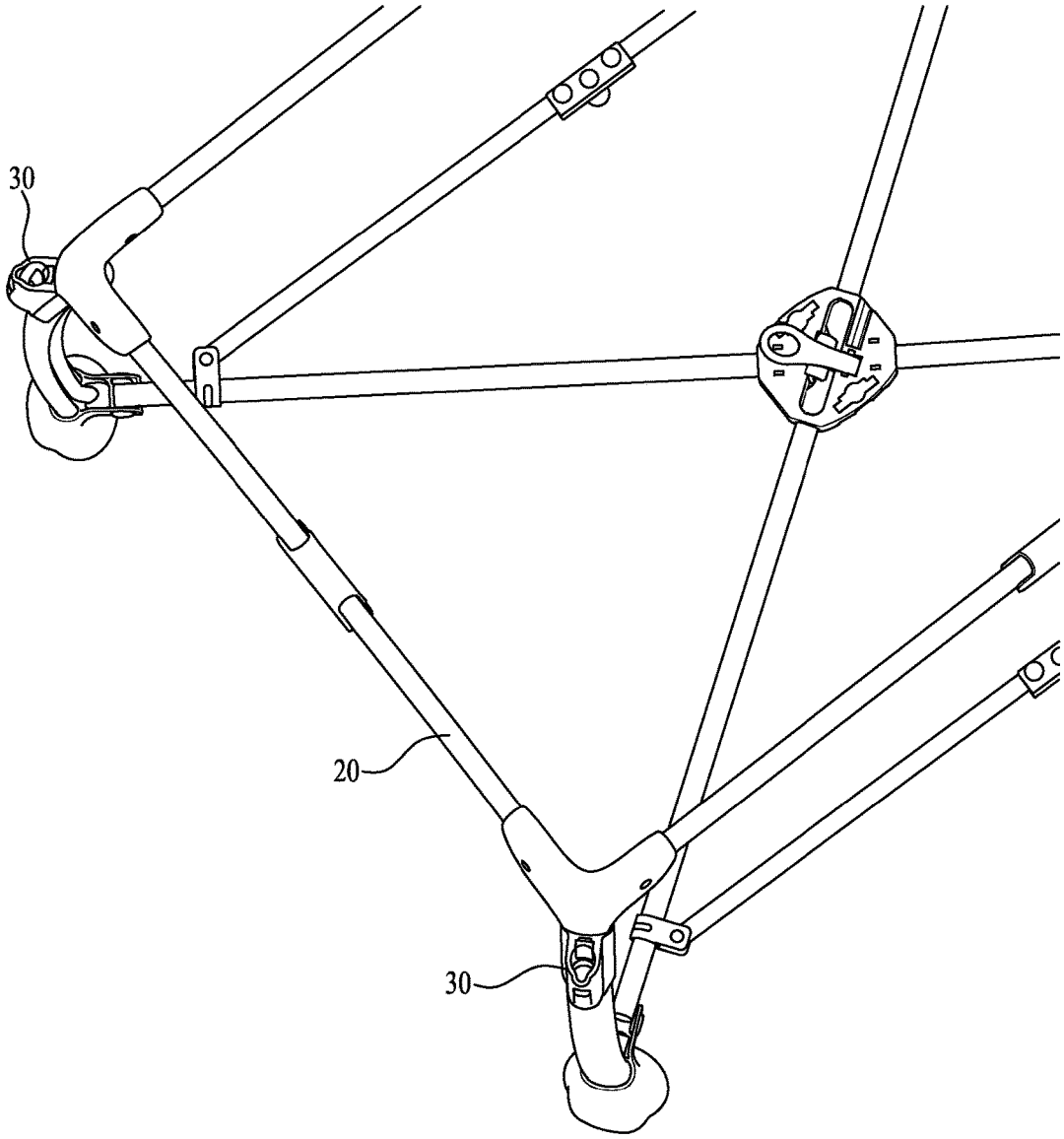
FIG. 4 is a top view showing mounting sleeves attached to the frame of the play yard device for receiving coupling members of the first child support unit to mount the child support unit to the play yard.
Figure 5:
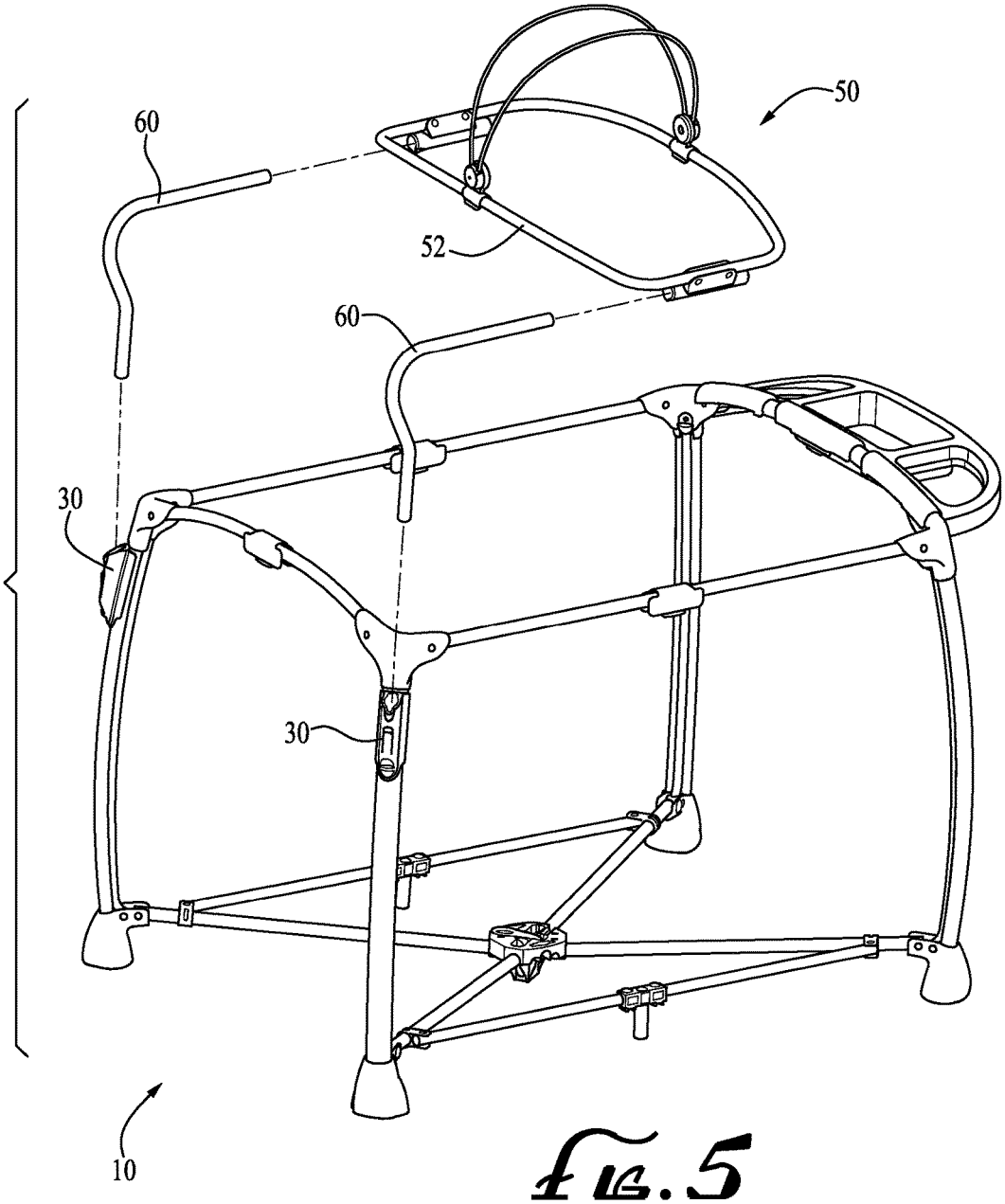
FIG. 5 is an assembly view of the play yard and the first child support unit.
Figure 6:
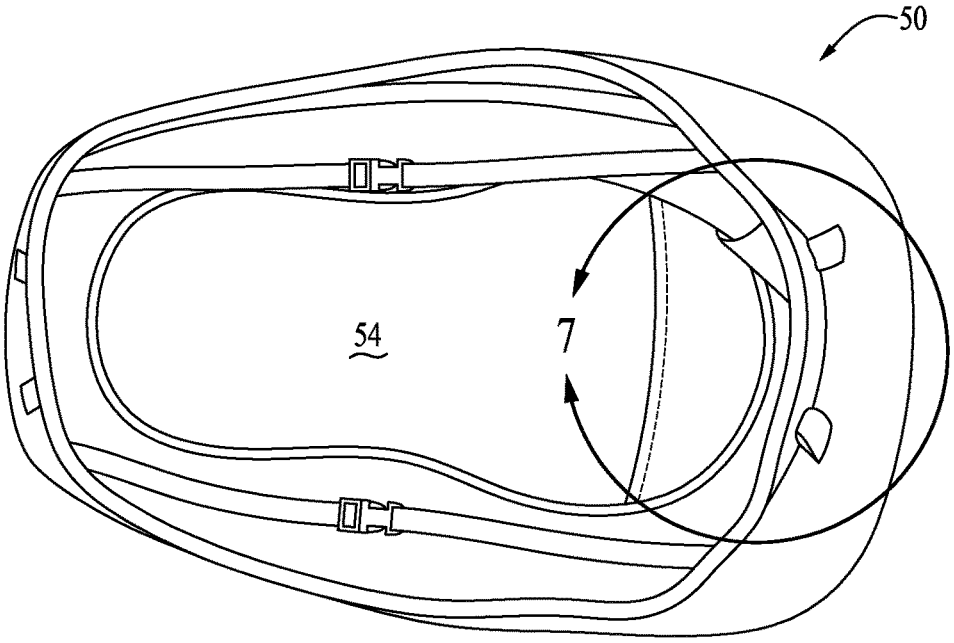
FIGS. 6-8 show further details of the child support unit according to an example form of the invention.
Figure 7:
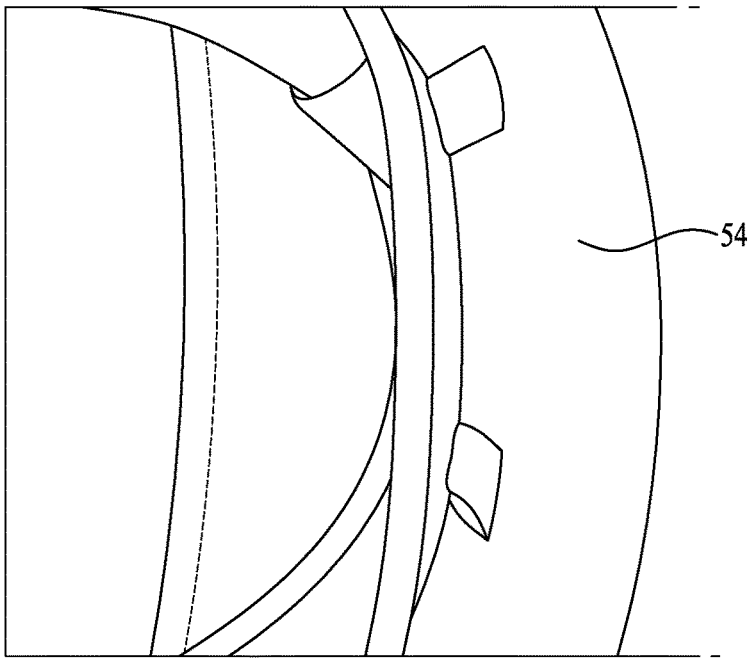

With reference now to the drawing figures, wherein like reference numbers represent corresponding parts throughout the several views, FIGS. 1, 4 and 5 show a play yard system 10 comprising a foldable frame having four corner posts 12, lower cross-bracing 14, lower siderails 16, upper siderails 18, and upper endrails 20. First and second mounting sleeves 30 are attached to the frame, for example along upper portions of the corner posts 12.

FIGS. 2, 3, and 6-8 show a first child support unit 50 configured for attachment to the frame of the play yard at a first location. In the depicted embodiment, the first child support unit 50 comprises a bassinet or cradle-like enclosure for receiving an infant or small child. The first child support unit 50 includes a subframe 52 comprising a generally rectangular periphery, soft-goods 54 such as fabric and padding installed onto the subframe forming a sling, bassinet or cradle for supporting a child placed in or on the support unit, and optionally a canopy 56 for covering at least a portion of the upper opening of the bassinet.

Figure 2:
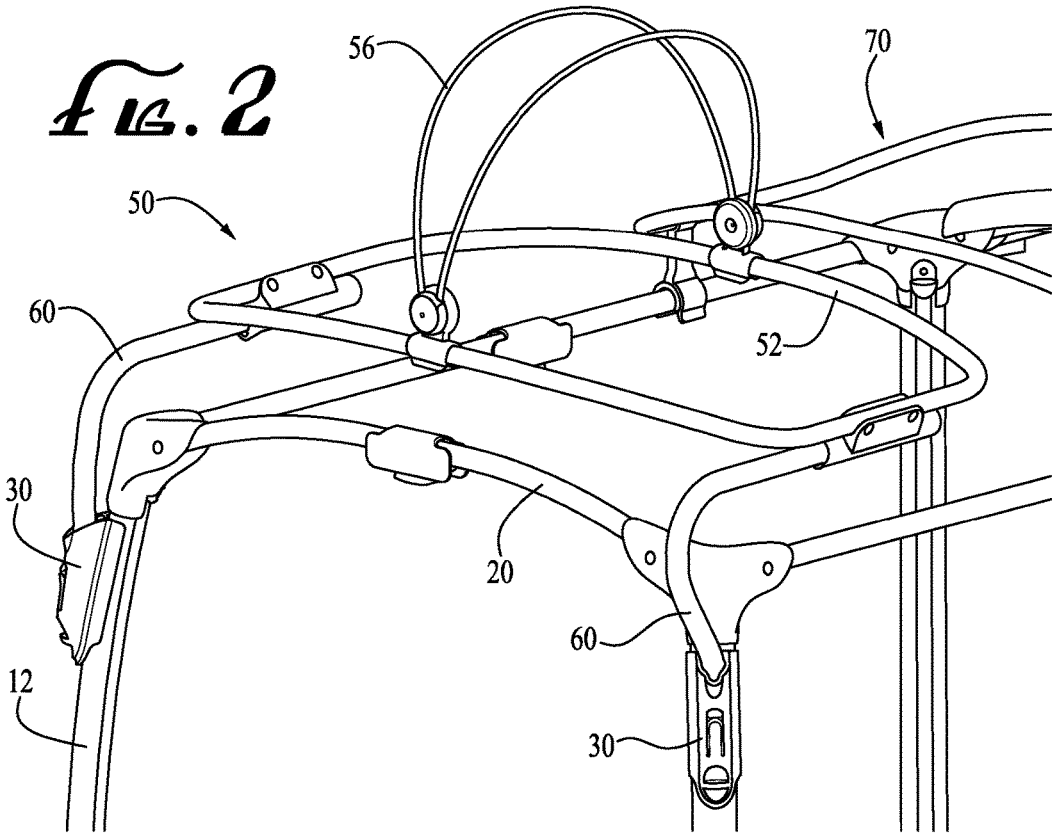
FIG. 2 is a perspective view showing greater detail of the support and mounting frame of the first child support unit.
Figure 3:
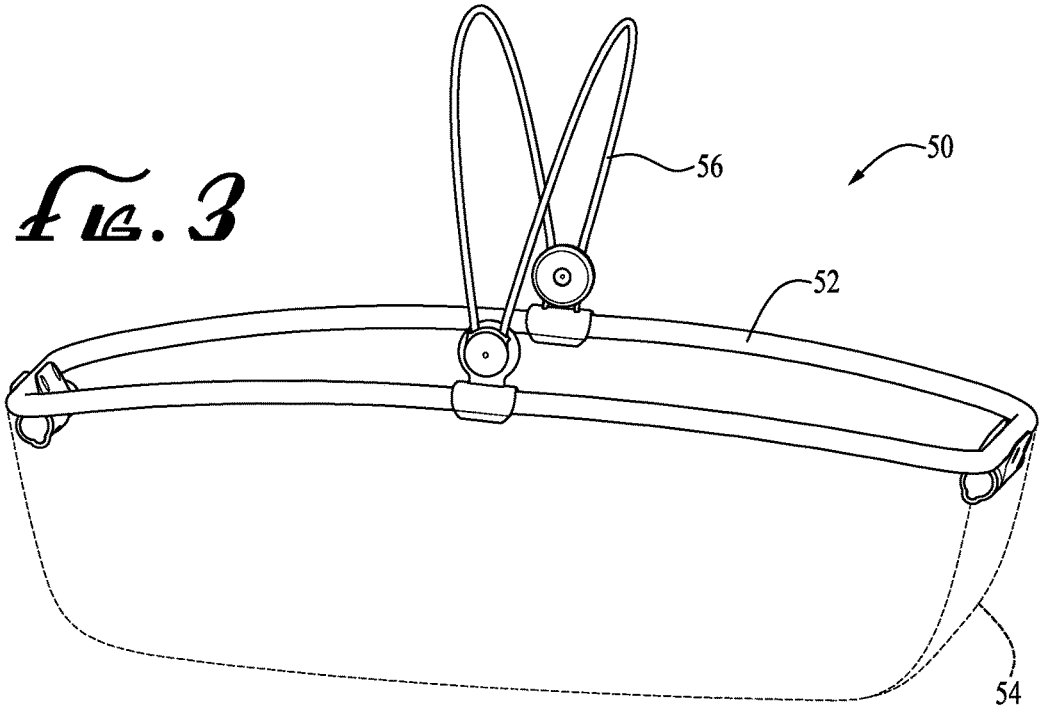
FIG. 3 is a perspective view of the first child support unit.
Figure 8:
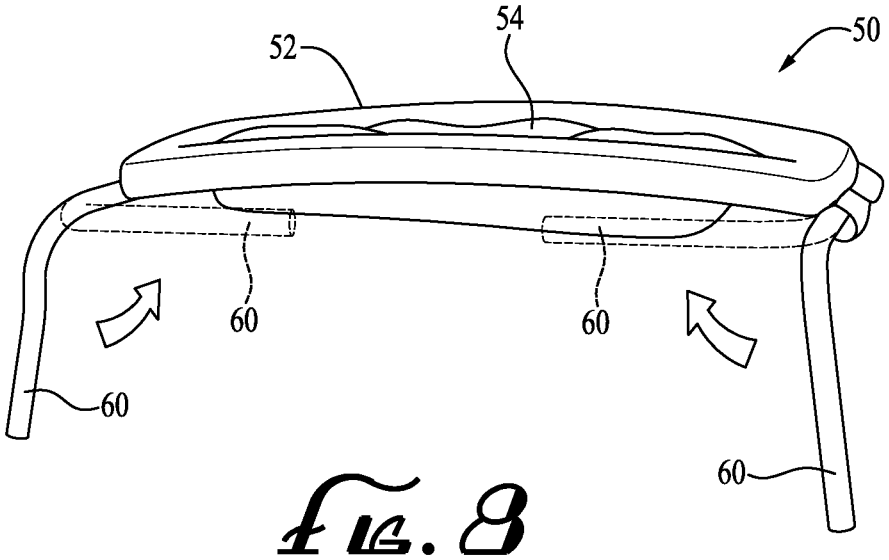

The first child support unit 50 is mounted to the play yard by at least one coupling, for example as shown in FIGS. 2 and 5. First and second mounting bars 60, each having a generally L-shaped configuration, have first ends for attachment to the frame of the play yard and second ends for attachment to the subframe of the first child support unit 50. For example, the first end of the mounting bar 60 is removably receivable within a corresponding mounting sleeve 30 attached to the frame of the play yard, and the second end of the mounting bar is receivable within a ferrule coupling attached to the subframe of the child support unit. As shown in FIG. 8, the mounting bars are optionally rotationally engaged within the ferrule couplings for compact storage when removed from the play yard frame. In alternate embodiments, various alternative coupling elements may be utilized for permanently or detachably mounting the child support unit to the play yard.

Optionally, the system 10 further comprises a second child support unit 70. For example, in the depicted embodiment, the second child support unit 70 comprises a changing table attachment having a generally rectangular subframe 72 to which a generally planar support panel may be mounted. One or more couplings 74 such as support struts with engagement clips secure the subframe of the second child support unit 70 to the frame of the play yard. One or more accessory trays or bins 80 are optionally mounted to the frame of the play yard, for holding toys, diapering supplies, a pacifier, or other items.

While the invention has been described with reference to preferred and example embodiments, it will be understood by those skilled in the art that a variety of modifications, additions and deletions are within the scope of the invention, as defined by the following claims.

The invention claimed is:

1. A child containment system comprising:

a base support frame having and upper rail and at least two support members configured to rest on an external support surface;

a first child receptacle for supporting a child therein, the first child receptacle having a first support frame separate from the base support frame, and a first child support surface; and a second child receptacle for supporting a child therein, the second child receptacle having a second support frame separate from the base support frame, and a second child support surface;

wherein the first child support surface is positioned at a first height with respect to the external support surface and the second child support surface is positioned at a second, different height with respect to the external support surface.

2. The child containment system of claim 1, wherein the first child receptacle is a child sleep unit.

3. The child containment system of claim 2, wherein the second child receptacle is a changing table.

4. The child containment system of claim 1, further comprising a bassinet.

5. The child containment system of claim 4, wherein the bassinet comprises a third child support surface.

6. The child containment system of claim 5, wherein the third child support surface is positioned below the first child support surface and the second child support surface.

7. The child containment system of claim 1, wherein the first support frame and the second support frame are positioned at substantially the same height with respect to the external support surface.

8. A child containment system comprising:

a base support frame having and upper rail and at least two support members configured to rest on an external support surface;

a first child receptacle for supporting a child therein, the first child receptacle having a first support frame independent of the base support frame; and a second child receptacle for supporting a child therein, the second child receptacle having a second support frame independent of the base support frame;

wherein the first support frame is coupled to at least one of the support members of the base support frame, and the second support frame is coupled to the upper rail of the base support frame; and wherein the first support frame and the second support frame are positioned at substantially the same height with respect to the external support surface.

9. The child containment system of claim 8, further comprising a bassinet.

10. The child containment system of claim 8, wherein the first child receptacle includes a connector and the support member includes a mating connector adapted to releasably engage the connector.

11. The child containment system of claim 10, wherein the connector is a cantilevered arm.

12. The child containment system of claim 11, wherein the mating connector is a receiving socket adapted to releasably receive a connecting portion of the cantilevered arm.

13. A child containment system comprising:

a support frame having an upper rail and at least two support members extending between the upper rail and a support surface; and a first child receptacle for supporting a child therein, the first child receptacle having a first support subframe separate from the support frame, and a first child support surface;

wherein the first child receptacle is releasable coupled to the support frame; and wherein the first support subframe is positioned above the upper rail of the support frame and the first child support surface is positioned below the upper rail of the support frame.

14. The child containment system of claim 13, wherein the first child receptacle is a sleep unit.

15. The child containment system of claim 14, further comprising a second child receptacle.

16. The child containment system of claim 15, wherein the second child receptacle is a changing table.

17. The child containment system of claim 13, further comprising a bassinet.

18. A child containment system comprising:

a support frame having an upper rail and at least two support members extending between the upper rail and a support surface, wherein the support frame defines an interior child receiving volume;

a first child receptacle for supporting a child therein, the first child receptacle being coupled to the support frame; and a second child receptacle for supporting a child therein, the second child receptacle being coupled to the support frame;

wherein no portion of either child receptacle overlies any portion of the other child receptacle, and wherein a horizontal space exists between the first child receptacle and the second child receptacle thereby allowing access to the interior child receiving volume through the space between the first child receptacle and the second child receptacle.

19. The child containment system of claim 18, wherein the first child receptacle has a first depth and the second child receptacle has a second depth, wherein the first depth is different from the second depth.

20. The child containment system of claim 18, further comprising a bassinet.

21. A child containment system comprising:

a base support frame having an upper rail and at least two support members;

a first child receptacle for supporting a child therein, the first child receptacle comprising a first support frame separate from the base support frame, and a first support arm, the first receptacle further having a length and a width;

wherein the first support arm comprises a substantially vertical segment and a substantially horizontal segment, wherein the substantially vertical segment is adapted to detachably couple to one of the support members and support the substantially horizontal segment above the upper rail.

22. The child containment system of claim 21, wherein the first support arm is detachably coupleable to the support frame.

23. The child containment system of claim 21, wherein the first segment of the support arm is substantially perpendicular to the length of the first child receptacle and substantially parallel to the width of the first child receptacle.

24. The child containment system of claim 23, wherein the second segment of the support arm is substantially perpendicular to the length of the first child receptacle and substantially perpendicular to the width of the first child receptacle.

25. The child containment system of claim 21, further comprising a second child receptacle having a length and a width.

26. The child containment system of claim 25, wherein the length of the first child receptacle and the length of the second child receptacle are substantially parallel.

* * * * *